US006301464B1

(12) United States Patent
Yuanzhu

(10) Patent No.: US 6,301,464 B1
(45) Date of Patent: Oct. 9, 2001

(54) SATELLITE BROADCASTING CONVERTER

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/348,643

(22) Filed: Jul. 6, 1999

(30) Foreign Application Priority Data

Jul. 14, 1998 (JP) ..... 10-198211

(51) Int. Cl.[7] ..... H04H 1/00
(52) U.S. Cl. ..... 455/3.02; 455/328
(58) Field of Search ..... 455/3.02, 323, 455/325, 328, 313, 3.01

(56) References Cited

U.S. PATENT DOCUMENTS 4,991,228 * 2/1991 Ohta et al. ..... 455/323
5,471,664 * 11/1995 Kim ..... 455/323
5,584,064 * 12/1996 Nakamura ..... 455/3.2

FOREIGN PATENT DOCUMENTS 8-84002 5/1996 (JP) .

* cited by examiner

*Primary Examiner*—Nguyen T. Vo

(57) ABSTRACT

In a satellite broadcasting converter, converting portions project from an inner face portion of a horn section, and therefore, the inner face of a waveguide section, the inner face portion of the horn section, and the converting portions can be formed by using a single mold. This reduces the number of molds, compared with the conventional converter, and thereby achieves a low-cost satellite broadcasting converter.

6 Claims, 5 Drawing Sheets

SATELLITE BROADCASTING CONVERTER

BACKGROUND OF THE INVENTION

1. Field of the Invention

The present invention relates to a satellite broadcasting converter with high productivity and high performance.

2. Description of the Related Art

A conventional satellite broadcasting converter will be described below with reference to FIGS. 7 to 10.

Referring to FIG. 7, a box-shaped metal housing 21, a cylindrical metal waveguide section 22, and a funnel-shaped metal horn section 23 are integrally formed by die casting using aluminum.

A circuit section (not shown) for receiving satellite broadcast waves, such as an RF circuit, is contained inside the housing 21, and cables are connected to a plurality of connectors 24 attached to the housing 21 so as to lead received waves indoors.

As shown in FIGS. 8 and 9, a converting portion 22*b*, formed of a nearly trapezoidal projection, projects from an inner surface 22*a* of the waveguide section 22 toward the center.

Circularly polarized waves are converted into linearly polarized waves by the converting portion 22*b*, and are input the satellite broadcast wave receiving circuit section.

Next, a description will be given of a method of producing the waveguide section 22 and the horn section 23 for the conventional satellite broadcasting converter.

As shown in FIG. 10, first, a columnar mold 31 for forming the inner surface of the hollow waveguide section 22 is placed to abut on a truncated conical mold 32 for forming the inner surface of the horn section 23 and a part of the inner surface of the waveguide section 22.

In this case, recesses 31*a* and 32*a* for defining the projecting converting portion 22*b* are formed in the abutting portions between the molds 31 and 32, which allows the mold 31 and the mold 32 to be pulled out in the directions of the arrows X and Y, respectively, after molding.

Moreover, a plurality of split molds 33 for forming the outline of the waveguide section 22 and the horn section 23 are placed to define a space portion 34 between the molds 31, 32, and 33, where the waveguide section 22, the converting portion 22*b*, and the horn section 23 are to be formed.

Subsequently, molten aluminum is injected in the space portion 34. When the aluminum has solidified, the mold 31 is pulled out in the direction of the arrow X, the mold 32 is pulled out in the direction of the arrow Y, and the molds 33 are removed, whereby the production of the waveguide section 22 and the horn section 23 is completed.

Since the converting portion 22*b* projects from the inner surface of the waveguide section 22 in the conventional satellite broadcasting converter, the production of the converter requires the mold 31 for forming the inner surface of the waveguide section 22, and the mold 32 for forming the inner surface of the waveguide section 22 and the inner surface of the horn section 23. This increases the number of molds, and therefore, increases the cost. Moreover, since the molds 31 and 32 must abut on each other, they suffer serious abrasion damage, and the service life thereof is shortened.

Furthermore, since the molds 31 and 32 must abut at the projecting converting portion 22*b*, burrs are formed in the abutting portions therebetween, which deteriorates performance, and necessitates deburring.

SUMMARY OF THE INVENTION

Accordingly, it is an object of the present invention to provide a satellite broadcasting converter that can be produced by a mold having a simple structure and without forming burrs.

In order to solve the above problems, according to an aspect of the present invention, there is provided a satellite broadcasting converter including a metal housing, a metal waveguide section connected to the housing at one and a metal horn section connected to the waveguide section at one end, wherein the horn section has a funnel-shaped inner face portion that gradually slopes to broaden away from the portion connected to the waveguide section, and a converting portion for converting circularly polarized waves into linearly polarized waves projects from a part of the inner face portion.

Preferably, the converting portion is formed of a triangular projection formed in a section surrounded by a linear portion having the same diameter as the inner diameter of the waveguide section to extend outward, a slope portion extending outward from one end of the linear portion toward the inner face portion, and the inner face portion.

The converting portion may be formed of a triangular projection formed in a section surrounded by a first slope portion that extends outward to gradually become greater than the inner diameter of the waveguide section, away from the portion connected to the waveguide section, a second slope portion extending outward from one end of the first slope portion toward the inner face portion, and the inner face portion.

Further objects, features, and advantages of the present invention will become apparent from the following description of the preferred embodiments with reference to the attached drawings.

DESCRIPTION OF THE PREFERRED EMBODIMENTS

Figure 1:
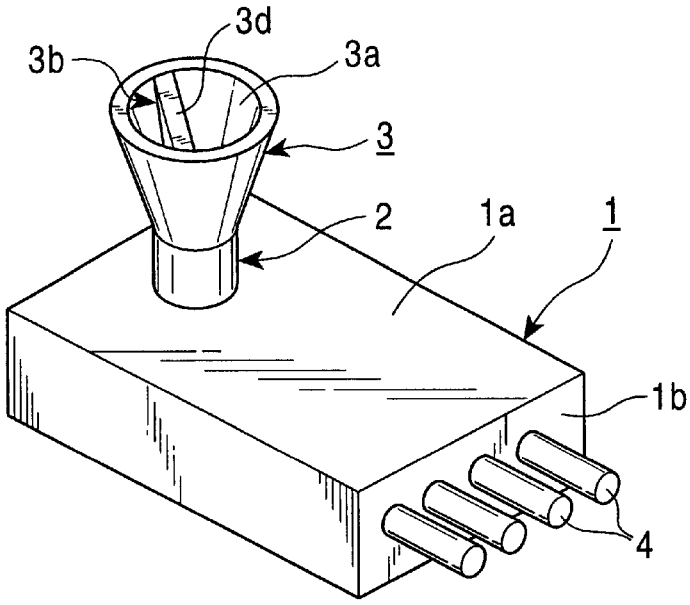
FIG. 1 is a perspective view of a satellite broadcasting converter according to an embodiment of the present invention.
Figure 2:
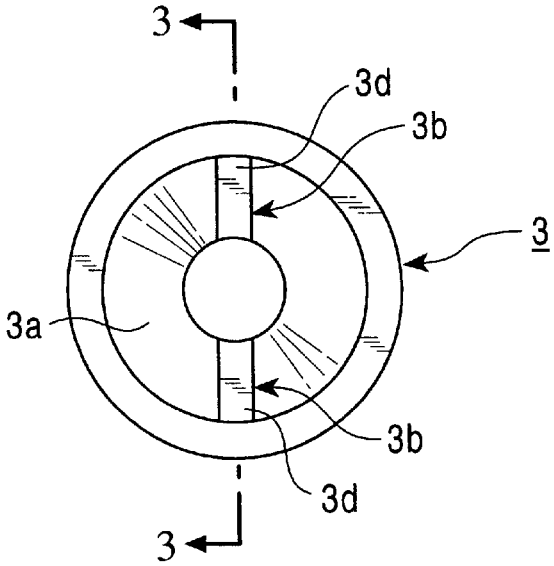
FIG. 2 is a front view of a horn section of the satellite broadcasting converter.

A satellite broadcasting converter according to an embodiment of the present invention will be described with reference to FIGS. 1 to 4. FIG. 1 is a perspective view of the satellite broadcasting converter of this embodiment, FIG. 2 is a front view of a horn section of the satellite broadcasting converter, FIG. 3 is a sectional view taken along line 3—3 of FIG. 2, and FIG. 4 is an explanatory view showing a method of producing a waveguide section and the horn section of the satellite broadcasting converter.

Referring to FIG. 1, a box-shaped metal housing 1, a cylindrical metal waveguide section 2, and a funnel-shaped metal horn section 3 are integrally formed by die casting using aluminum so that one end of the waveguide section 2 is connected to an upper wall 1*a* of the housing 1, and the other end thereof is connected to one end of the horn section 3.

A circuit section (not shown) for receiving satellite broadcast waves, such as an RF circuit, is contained inside the housing 1, and cables are connected to a plurality of connectors 4 attached to a side wall 1*b* of the housing 1 so as to lead received waves indoors.

Figure 3:
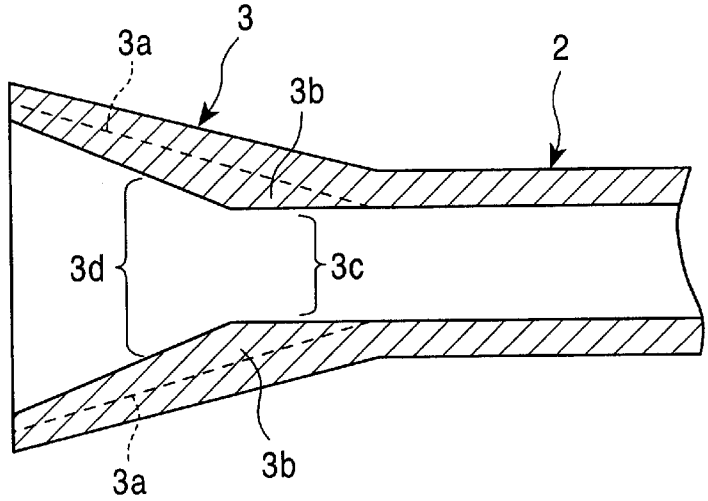
FIG. 3 is a sectional view taken along line 3—3 of FIG. 2.
Figure 4:
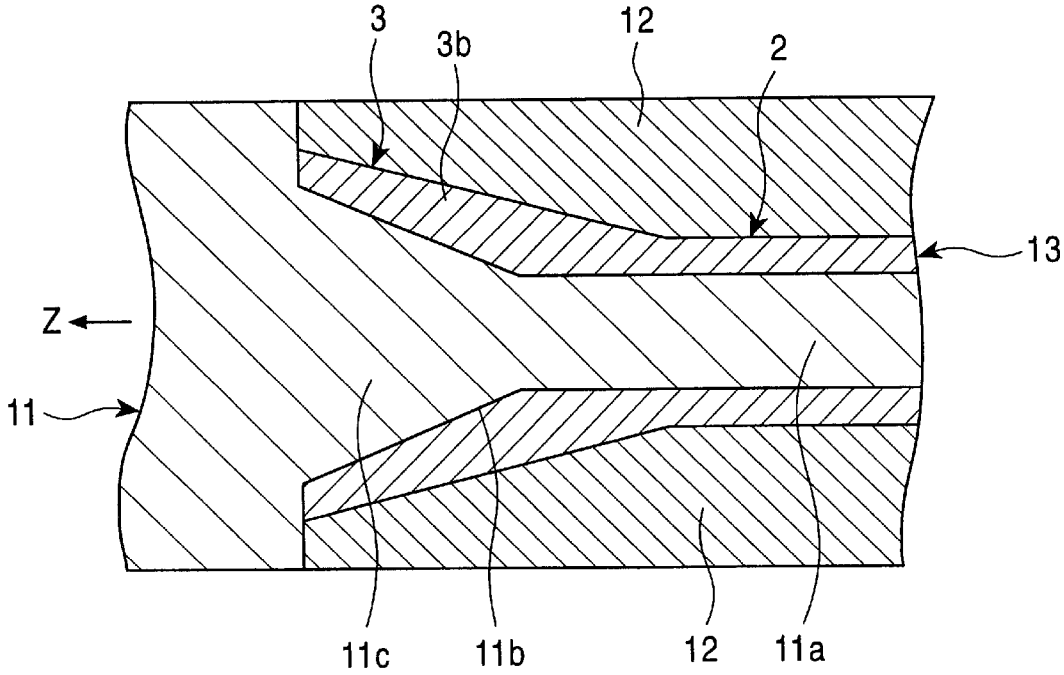
FIG. 4 is an explanatory view showing a method of producing a waveguide section and the horn section of the satellite broadcasting converter.

As shown in FIGS. 3 and 4, the horn section 3 includes a funnel-shaped inner face portion 3*a* that slopes to broaden away from the portion connected to the waveguide section 2, and a pair of opposing converting portions 3*b* that project from a part of the inner face portion 3*a*.

Each of the projecting converting portions 3*b* is formed of a triangular projection surrounded by a linear portion 3*c* having the same diameter as the inner diameter of the waveguide section 2 so as to extend outward, a slope portion 3*d* extending outward from one end of the linear portion 3*c* toward the inner face portion 3*a*, and the inner face portion 3*a*.

Circularly polarized waves are converted into linearly polarized waves by the converting portions 3*b*, and are input to the satellite broadcast wave receiving circuit section.

Next, a description will be given of a method of producing the waveguide section 2 and the horn section 3 of the satellite broadcasting converter of this embodiment.

As shown in FIG. 4, first, a mold 11 is positioned that includes a columnar portion 11*a* for forming the entire inner face of the hollow waveguide section 2, and a truncated conical portion 11*c* for forming the entire inner face 3*a* of the horn section 3, the truncated conical portion 11*c* having recesses 11*b* for forming the converting portions 3*b* formed of triangular projections.

Next, a plurality of split molds 12 for forming the outline of the waveguide section 2 and the horn section 3 are positioned to define a space portion 13 between the molds 11 and 12, where the waveguide section 2, the horn section 3, and the converting portions 3*b* are to be formed.

Subsequently, molten aluminum is injected in the space portion 13. When the aluminum has solidified, the mold 11 is pulled out in the direction of the arrow Z, and the molds 12 are removed, whereby the production of the waveguide section 2 and the horn section 3 is completed.

Figure 5:
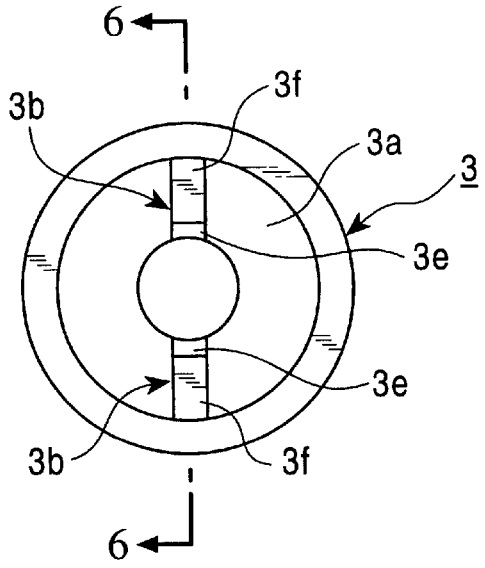
FIG. 5 is a front view of a horn section of a satellite broadcasting converter according to another embodiment of the present invention.
Figure 6:
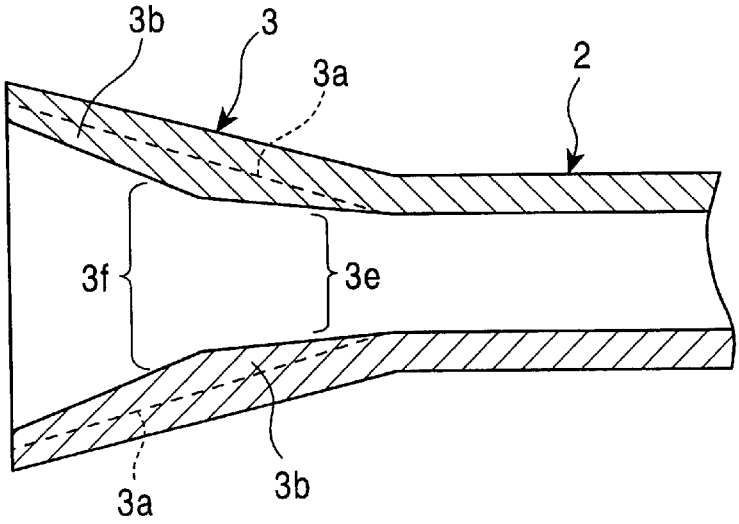
FIG. 6 is a sectional view taken along line 6—6 of FIG. 5.
Figure 7:
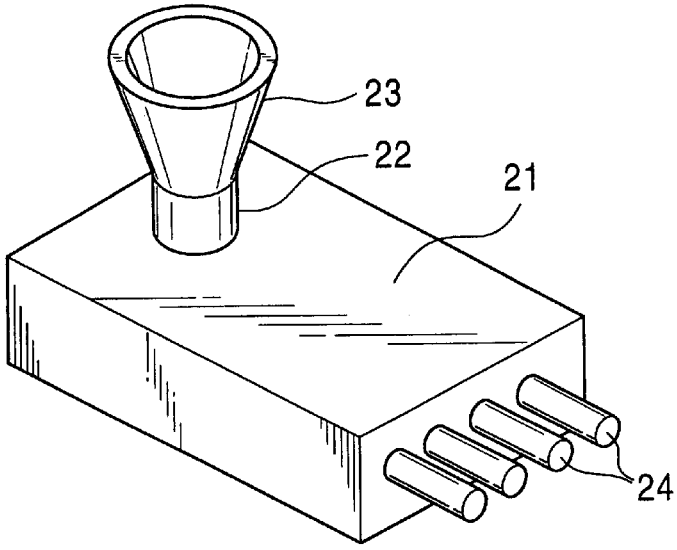
FIG. 7 PRIOR ART
FIG. 7 is a perspective view of a conventional satellite broadcasting converter.
Figure 8:
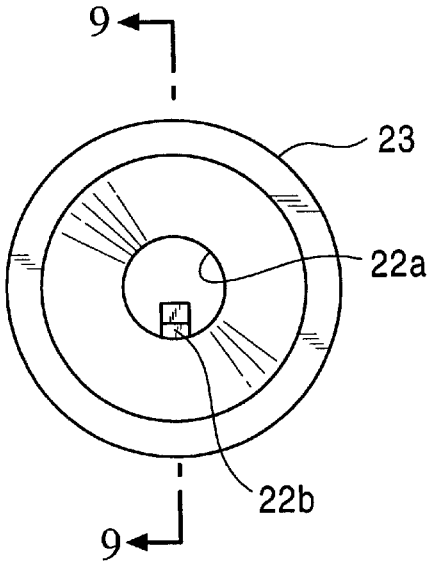
FIG. 8 PRIOR ART
FIG. 8 is a front view of a horn section of the conventional satellite broadcasting converter.
Figure 9:
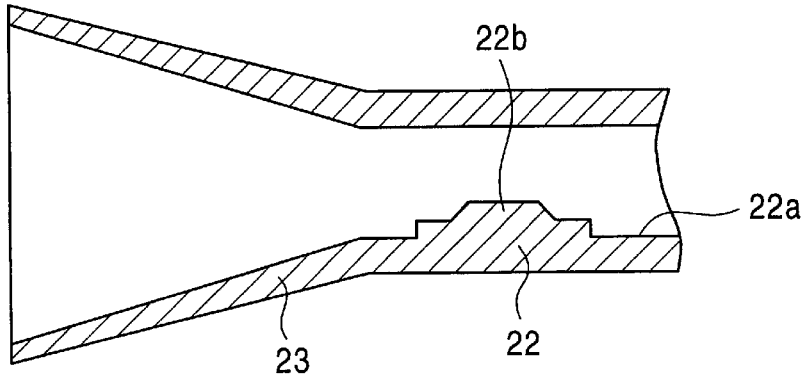
FIG. 9 PRIOR ART
FIG. 9 is a sectional view taken along line 9—9 of FIG. 8.
Figure 10:
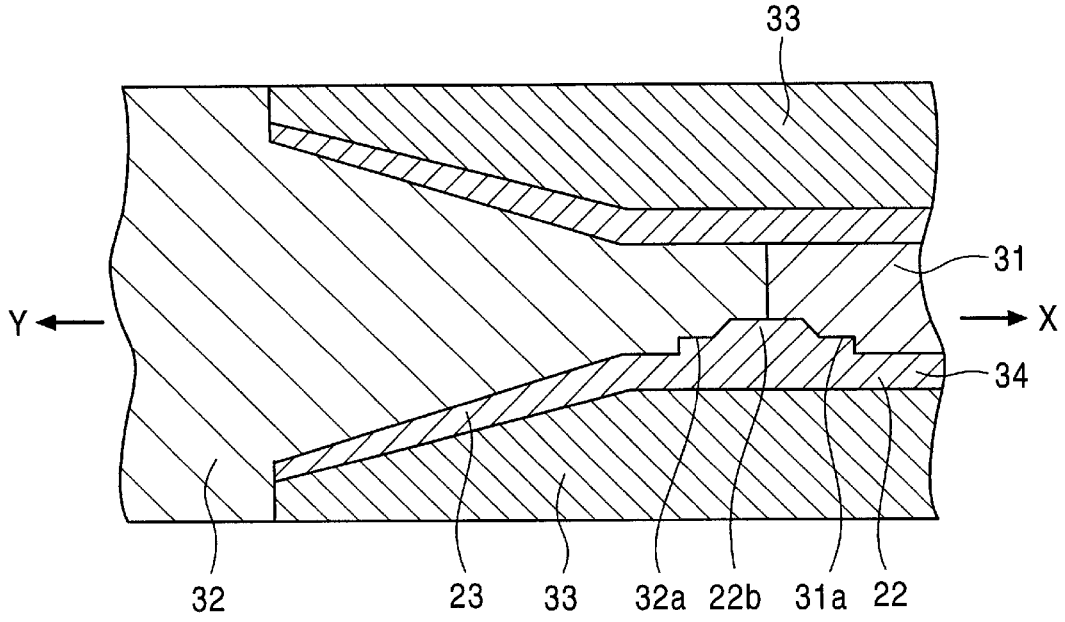
FIG. 10 PRIOR ART
FIG. 10 is an explanatory view showing a method of producing a waveguide section and the horn section of the conventional satellite broadcasting converter.

FIGS. 5 and 6 shows a satellite broadcasting converter according to another embodiment of the present invention. In this embodiment, converting portions 3*b* are formed of a triangular projection surrounded by a first slope portion 3*e* that extends outward so as to gradually become greater than the inner diameter of the waveguide section 2, away from the portion connected to the waveguide section, a second slope portion 3*f* that extends outward from one end of the first slope portion 3*e* toward the inner face portion 3*a*, and the inner face portion 3*a*.

Since other structures are similar to those in the above-described embodiment, the same components are denoted by the same numerals and description thereof is omitted.

A method of producing the waveguide section 2 and a horn section 3 in this embodiment is slightly different from that of the above embodiment only in the shape of the converting portions 3*b*, that is, in the shape of the recesses 11*b* of the mold 11.

The two converting portions 3*b* formed of projections in the above embodiments may be replaced with a single converting portion, and may take various forms other than the above.

In the satellite broadcasting converter of the present invention, since the converting portions 3*b* are formed of projections on the inner face portion 3*a* of the horn section 3, the inner surface of the waveguide section 2, the inner face portion 3*a* of the horn section 3, and the converting portions 3*b* can be formed by the single mold 11. This reduces the number of molds, compared with that necessary for the conventional converter, and thereby provides a low-cost satellite broadcasting converter.

Since such a single mold 11 does not undergo abrasion due to abutting, as is different from the conventional converter, the service life thereof is prolonged. This makes it possible to provide a low-cost satellite broadcasting converter that achieves high productivity.

The converting portions 3*b* are formed of a triangular projection surrounded by the linear portion 3*c* having the same diameter as the inner diameter of the waveguide section 2 to extend outward, the slope portion 3d extending outward from one end of the linear portion 3*c* toward the inner face portion 3*a*, and the inner face portion 3*a*. Therefore, it is possible to provide a low-cost satellite broadcasting converter in which a mold has a simple structure and the production cost thereof is low.

When the converting portions 3*b* are formed of a triangular projection surrounded by the first slope portion 3*e* that extends outward so as to gradually become greater than the inner diameter of the waveguide section 2, away from the portion connected to the waveguide section, the second slope portion 3*f* that extends outward from one end of the first slope portion 3*e* toward the inner face portion 3*a*, and the inner face portion 3*a*, it is also possible to provide a low-cost satellite broadcasting converter in which a mold has a simple structure and the production cost thereof is low.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A satellite broadcasting converter comprising:

a metal housing;

a metal waveguide section connected to said housing at one end; and a metal horn section connected to said waveguide section at one end, wherein said horn section has a funnel-shaped inner face portion that gradually slopes to broaden away from a portion connected to said waveguide section and a converting portion for converting circularly polarized waves into linearly polarized waves projects from a part of said inner face portion.

2. A satellite broadcasting converter according to claim 1, wherein said converting portion is formed of a triangular projection formed in a section surrounded by a linear portion having a diameter equal to an inner diameter of said waveguide section, a slope portion extending outward from one end of said linear portion toward said inner face portion, and said inner face portion.

3. A satellite broadcasting converter according to claim 1, wherein said converting portion is formed of a triangular projection formed in a section surrounded by a first slope portion that extends outward to gradually become greater than an inner diameter of said waveguide section away from a portion connected to said waveguide section, a second slope portion extending outward from one end of said first slope portion toward said inner face portion, and said inner face portion.

4. A satellite broadcasting converter comprising:

a metal housing;

a metal waveguide section connected to said housing at an end; and a metal horn section having one end connected to an opposing end of said waveguide section and an opposing end open, wherein said horn section has a funnel-shaped inner face portion that gradually slopes to broaden from said one end toward said opposing end thereof, said inner face portion has a converting portion for converting circularly polarized waves into linearly polarized waves, and said converting portion is a ridge at least as large as an inner diameter of said waveguide section that projects from said inner face portion and extends in an axial direction of said waveguide section.

5. A satellite broadcasting converter according to claim 4, wherein said ridge is formed by a triangular projection formed in a section surrounded by a linear portion having a diameter equal to the inner diameter of said waveguide section and extending toward said one end of said horn section, a slope portion extending from one end of said linear portion toward said inner face portion and said opposing end of said horn section, and said inner face portion.

6. A satellite broadcasting converter according to claim 4, wherein said ridge is formed by a triangular projection formed in a section surrounded by a first slope portion extending from said one end of said horn section toward said opposing end of said horn section and having a diameter that gradually increases from the inner diameter of said waveguide section at said one end of said horn section, a second slope portion extending from one end of said first slope portion toward said inner face portion and said opposing end of said horn section, and said inner face portion.

* * * * *